United States Patent [19]

Braun et al.

[11] 4,221,495

[45] Sep. 9, 1980

[54] ROLL-ON APPLICATOR WITH SHARP SEALING RING

[75] Inventors: Morris Braun, Chicago, Ill.; George B. Spransy, Oconomowoc, Wis.

[73] Assignee: W. Braun Company, Chicago, Ill.

[21] Appl. No.: 7,577

[22] Filed: Jan. 29, 1979

[51] Int. Cl.[3] ..... B43K 9/00

[52] U.S. Cl. ..... 401/213

[58] Field of Search ..... 401/213, 214, 245, 269

[56] References Cited

U.S. PATENT DOCUMENTS

| | | | |
|---|---|---|---|
| 2,823,403 | 2/1958 | Whitney | 401/213 |
| 2,937,391 | 5/1960 | Phillips | 401/213 |
| 2,997,731 | 8/1961 | Schultz | 401/213 |
| 2,998,616 | 9/1961 | Gentile | 401/213 |
| 3,259,935 | 7/1966 | Miller | 401/213 X |

*Primary Examiner*—John D. Yasko

*Attorney, Agent, or Firm*—Kegan, Kegan & Berkman

[57] ABSTRACT

A roll-on type applicator assembly including a ball-type plastic fitment secured to the collar of a liquid dispensing container, and a closure therefor. The fitment includes an integrally formed sealing ring which constitutes a sharp rim formed at the intersection of a pair of angled annular faces. The applicator ball is supported in the fitment by means of an annular array of spring plates which bias the applicator ball upwardly of and out of contact with the sealing ring when the cap is removed from the container. The cap is formed on the underside of the inner surface of its domed top wall with a plurality of flexible fingers oriented symmetrically with respect to a vertical axis of the container, the fingers extending downwardly to engage the upper surface of the ball and to urge the ball resiliently into contact against the relatively inflexible sealing ring when the cap is tightened in place on the container, thereby to establish a fluid-tight sealing engagement between the sealing ring and the ball to prevent escape of fluid from the container during periods of non-use.

7 Claims, 8 Drawing Figures

ROLL-ON APPLICATOR WITH SHARP SEALING RING

BACKGROUND OF THE INVENTION

The present invention relates to a roll-on applicator of the type used to apply a liquid to a body surface. More particularly, the invention is directed to an improvement in an applicator ball-holding fitment, and improved means by which the applicator ball is positively sealed against a well-defined, firm, sealing ring when the cap is applied to the container as a closure therefor.

Ball-retaining fitments of the general type in which the present invention finds utility are well known in the art. For the most part, such prior art structures include sealing suraces against which the roll-on ball is stressed in order to seal the container against fluid loss or spillage during periods of non-use. Such prior art devices also include mechanical means by which the applicator ball is urged upwardly to clear the seat and to establish a fluid passage, when the closure or top is removed from the assembly. Additionally, such prior art structures also include mechanical means by which the ball is forcibly pushed downwardly to engage and bear against the sealing surface when the container is closed by application of the top.

In accordance with the present invention it has been discovered that there are important, critical relationships between the several mechanical elements which constitute the means by which the applicator ball is maintained in its various functional positions. It has been established, in accordance with the invention that only through adherence to precise, specific mechanical parameters and structural configurations can the operation of the fitment assembly be optimized. For example, prior art fitment structures have commonly utilized applicator ball sealing surfaces which are generally annular planar faces against which the ball abuts tangentially. In cooperation with such sealing faces, the prior art structures have also taught the use of substantially rigid and inflexible means by which the ball is pressed into engagement against the "planar" sealing surface. Such constant, positive pressure has the undesirable effect of inducing cold flow in both the applicator ball and the contacting sealing surface. As a result, surface irregularities develop in the ball and in the ball-contacting surface itself. These irregularities obviate effective subsequent sealing.

An additional structural deficiency of many of the prior art assemblies is that they fail to provide effective spring elements for elevating the ball to a position free of the sealing seat, with the result that the free-flow of liquid past the applicator ball is impaired. It is an important feature of the present invention that the above and other shortcomings and deficiencies of prior art applicator ball fitment constructions are obviated by providing an assembly in which each of the requisite functions is ensured through the use of a novel combination of intercooperating mechanical elements. These elements include spring tensioning support means for the applicator ball in combination with spring pressure elements for seating the ball, and a positive sealing wedge or ring against which the ball is resiliently secured.

A specific object of the invention is to provide a cap or closure with flexible pressure-applying fingers which exert an axial pressure against the applicator ball when the cap is in its top-closing position to force the ball downwardly and inwardly into the fitment to seat, in fluid sealing engagement, against the sealing ring of the fitment.

A related object of the invention is to provide such flexible pressure-applying fingers which will accommodate and compensate for any dimensional variability in tolerance between the fitment and the sealing ring so that the fluid-tight seal of the assembly will always be effective.

Another specific object of the invention is to provide a fitment which includes relief spring elements to bias the applicator ball upwardly and position the ball to clear the sealing ring so that an unpaired fluid passage is provided for application of the liquid to the surface to be treated.

A related feature of the invention is that with the cap removed from the assembly, spring-like elements engaging the undersurface of the applicator ball urge the ball upwardly to abut and to seal against a ball-encircling band at the mouth of the fitment to prevent spillage of fluid from the container. Inversion of the assembly and application of slight pressure against the ball serves to displace the ball from the sealing band and to permit fluid flow from the container.

Other and further objects, advantages, and features of the invention will be evident from the following description considered in conjunction with the drawings.

DESCRIPTION OF THE PREFERRED EMBODIMENT

The aims and objects of the invention are accomplished by providing a fitment which includes integrally formed ball support elements resiliently biasing the ball upwardly, and which also includes an integrally-formed sealing ring above which the applicator ball is supported by the biasing elements. The critical functional elements of the assembly also include a plurality of pressure-applying fingers which are integrally formed on the under surface of the top or closure element to project downwardly and to bear upon the applicator ball when the cap is applied in position, thereby to urge the ball into firm yet resiliently tensioned sealing engagement against the sealing ring to prevent escape of liquid from the container during periods of non-use. Significantly, the sealing ring is so formed physically that it presents a relatively sharp and well-defined edge or annular apex which sealingly engages the surface of the applicator ball when the cap is positioned in place to close the container.

Figure 7:
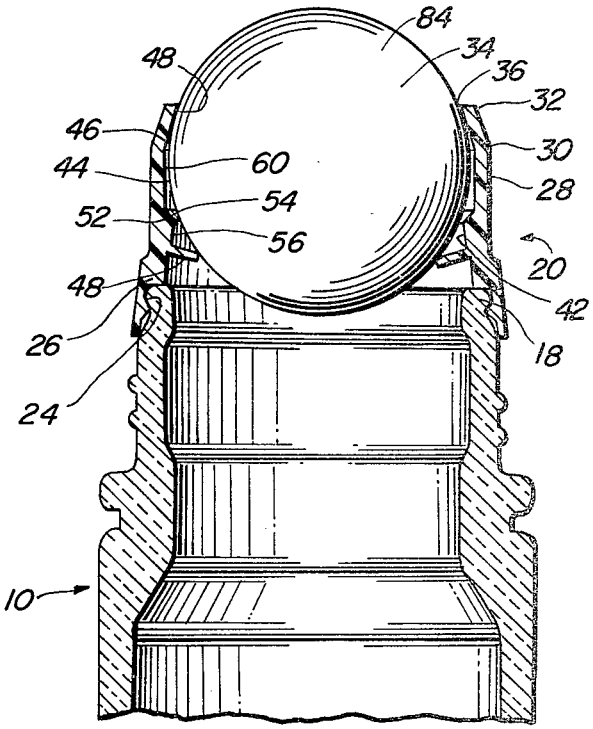
FIG. 7 is an enlarged cross-sectional view taken substantially on the lines 7—7 of FIG. 2 and showing the applicator ball biased upwardly by the spring fingers to clear the sealing ring and to establish an annular fluid passage from the interior of the container to the applicator surface of the ball.

Referring now to the drawings, a preferred embodiment is shown for purposes of illustrative disclosure. In the specific form of the invention depicted, the container or bottle 10 is preferably of glass or of a relatively rigid plastic composition such as linear polyethylene. The neck 14 of the container 10 terminates at its upper open end in an annular collar 18 to which a plastic fitment 20 is attached in snap-fit over-coupling engagement, as shown in FIG. 7. Positive intercoupled securement between the fitment 20 and the neck 14 of the container 10 is assured by engagement of the collar 18 of the neck within a cooperating annular groove or channel 24 formed in the sleeving lower portion 26 of the fitment 20.

Figure 1:
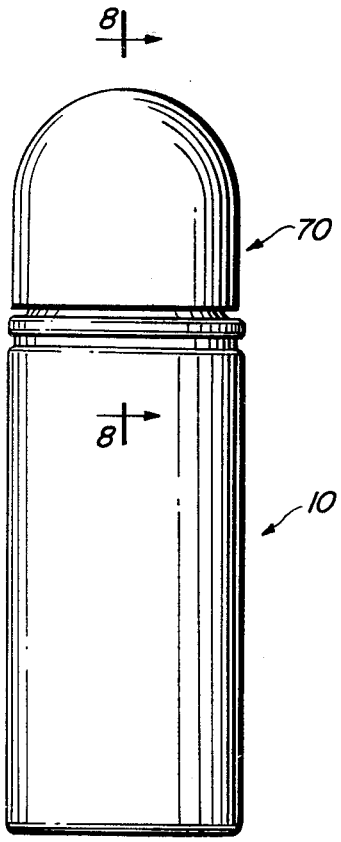
FIG. 1 is a front elevational view of a dispensing container of the type in which the present invention finds utility, and showing the cap or closure applied thereto.
Figure 2:
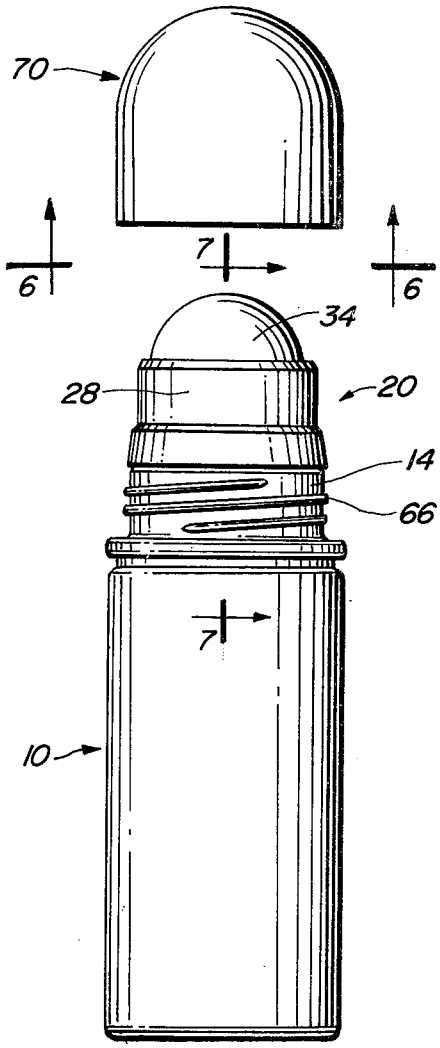
FIG. 2 is a view similar to that shown in FIG. 1, but with the cap removed to show the applicator ball and the embracing fitment.
Figure 3:
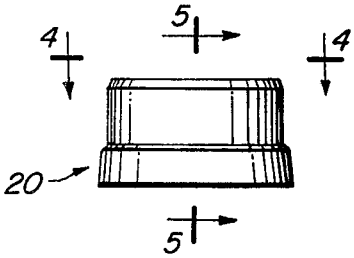
FIG. 3 is a front elevational view of the fitment, with the applicator ball removed.
Figure 4:
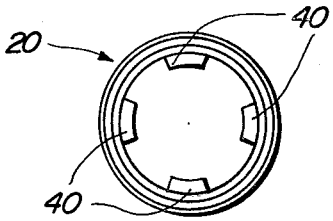
FIG. 4 is a top plan view of the fitment showing the spring fingers for supporting the applicator ball.
Figure 5:
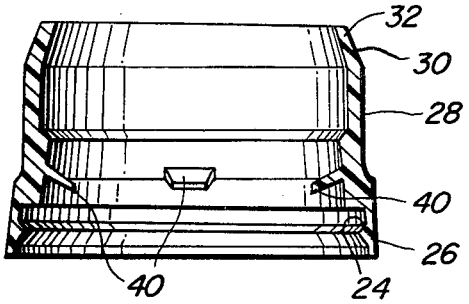
FIG. 5 is an enlarged cross-sectional view taken substantially on the lines 5—5 of FIG. 3 and showing the spring support fingers and the sealing ring of the invention.

The fitment 20 is generally cylindrical in form, including a wall 38 which is constricted somewhat at its upper open end 30 to form a ball-contacting band 32. The plastic of the fitment is sufficiently resilient to permit the forcible insertion of an applicator ball 34 through the constricted mouth 36 of the fitment, as shown in FIG. 7. As held within the fitment 20, the ball 34 bears resiliently against spring-like support elements 40 which are integrally formed with the fitment 20 to project inwardly of the internal wall 42 of the fitment, the support elements 40 constituting, in the preferred embodiment of the invention shown (FIG. 4) a plurality of circumferentially disposed spring-like plates 40 which, when the closure cap of the assembly is removed, bias the applicator ball upwardly to establish a condition under which fluid may flow from the container and through an annular passage 44 between the lateral curved surface 46 of the applicator ball 34 and the inner surface 48 of the embracing cylindrical wall 28 of the fitment 20, and then through the annular port or mouth 36 between the ball 34 and the band 32 when the applicator ball 34 is brought into engagement with a surface to be coated.

With the closure cap of the assembly removed, and in the absence of contacting engagement between the applicator ball 34 and a surface to be coated, the ball 34 is biased upwardly by the spring plates 40 to engage the circumambient sealing lip or band 32, thereby to prevent uncontrolled discharge of liquid from the container 10.

The method by which the container 10 is sealed during storage periods of non-use to prevent liquid evaporation or spillage is a critical feature of the present invention. The fitment 20 is integrally formed, at a horizontal plane which is below a horizontal diametric plane of the applicator ball 34 with a novel sealing ring, rib or rim 52. The ring 52 defines a relatively sharp edge-like rim formed at a juncture of a pair of angled, intersecting annular faces 54 and 56 of the fitment 20 projecting from and converging inwardly of a bounding internal wall 60 of the fitment 20 and defining a radially inwardly directed, tapered annular wedge terminating in a ball-encircling apex.

Figure 8:
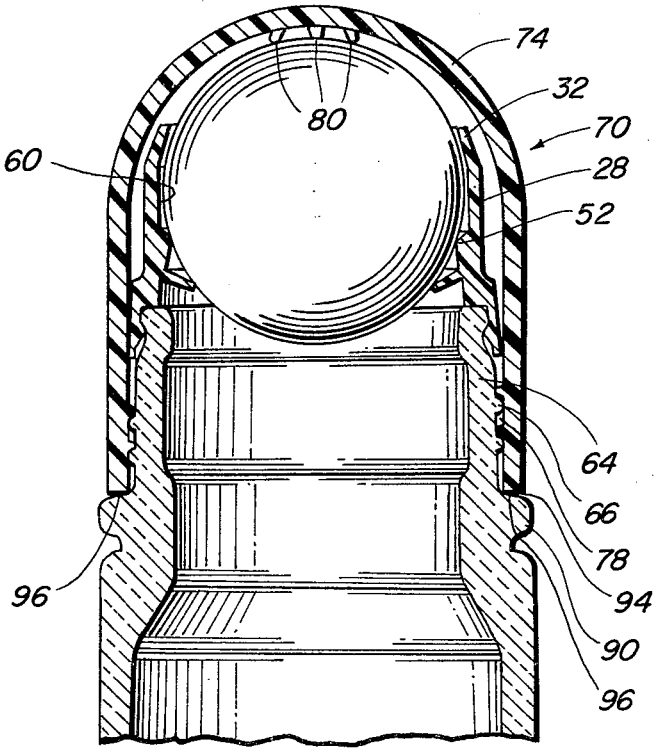
FIG. 8 is an enlarged cross-sectional view taken substantially on the lines 8—8 of FIG. 1 and showing the cap or closure of the assembly in place with the pressure fingers of the closure cap bearing down upon the applicator ball to displace the ball-supporting spring elements and to seat the ball agaist the wedge-like edge of the sealing ring.

The manner in which the container is sealed through stressed interengagement between the applicator ball 34 and the edge-like sealing ring 52 is indicated in FIG. 8. As shown, the neck 64 of the bottle 10 is formed with screw threads 66, and the cap or closure 70, which is a generally cylindrical section having a closed vaulted dome, is formed at a lower inner wall portion with internal threads 78 adapted to engage and mesh with the external threads 66 of the fitment 20 so that the cap 70 may be threadedly secured to the neck 64 of the container 10.

Figure 6:
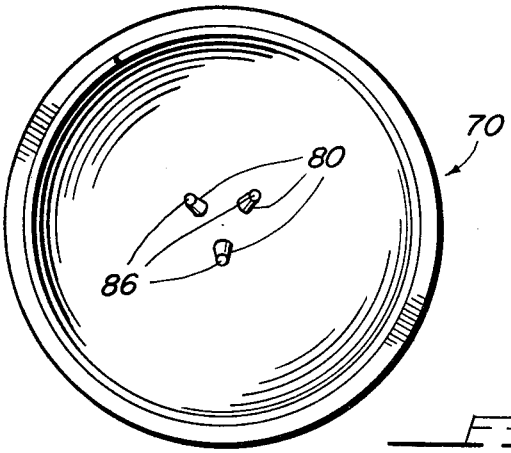
FIG. 6 is a planned view of the closure of the container, taken substantially on the lines 6—6 of FIG. 2 and showing the spring fingers which bear upon the applicator ball to seat the ball against the sealing ring when the container is closed.

As shown in FIGS. 6 and 8, the vaulted dome 74 of the closure cap 70 is formed on an internal top surface thereof with a plurality of downwardly projecting tapered flexible fingers 80 which are inclined outwardly from a vetical axis of the closure cap to flex and to bear resiliently upon the applicator ball 34 and to press down upon and to seat and to center the ball 34 against the sealing ring 52 when the closure cap 70 is threadedly secured in place on the container 10. The downward pressure of the fingers 80 in the closing process is sufficent to displace the spring plates 40 downwardly to permit the ball firmly and positively to seat against the sealing ring 52, all as clearly indicated in FIG. 8.

The pressure-applying fingers 80 are annularly spaced with respect to a longitudinal axis of the container to define an axially symmetrical circular locus ensuring that the pressure applied to the top surface 84 of the ball 34 will be radially equalized and will cause the ball to center within or against the sealing ring 52. Further to ensure even distribution of pressure and the proper sealing of the applicator ball 34 with the edge of the ring 52, the ball-contacting free ends 86 of the fingers 80 are rounded as at 86, to minimize friction. While any plural number of pressure fingers 80 may be used, three such symmetrically disposed fingers are preferred.

Referring again to FIG. 8, the bottle 10 is formed at the base of its neck 64 with a circumambient ridge 90 defining a shoulder 94. When the cap 70 is threadedly applied to the neck 64 of the container, the lower free edge 96 of the generally cylindrical cap wall abuts against and establishes a fluid-tight seal with the shoulder 94 to establish an air-tight chamber between the exposed surface of the applicator ball 34 and the interior of the closure cap 70. The effect is to prevent evaporation of fluid from and deposition of solids on the exposed surface of the ball 34 during periods of non-use of the applicator.

The foregoing invention has been described with reference to a preferred embodiment, and numerous equivalents thereof can be made without departing from the spirit and scope of the invention as defined in the following claims.

What is claimed is:

1. A roll-on applicator assembly comprising, in combination, a container having an outlet end, a ball-type plastic fitment at the outlet end of said container and secured thereto at a mouth thereof, an applicator ball coaxial with and rotatably retained in said fitment, an upper portion of said ball projecting above said fitment and normally exposed when said applicator assembly is in use, a cap positionable as a cover for said fitment and attachable to said container as a closure therefor, sealing ring means integrally formed with said fitment and defining an annular fluid-tight seating rib for said ball when said cap is applied to close said container, said cap and said ball constituting, in cooperation with said sealing ring means on said fitment, means to prevent escape of fluid from said container upon closure thereof, said sealing ring means being displaced below a horizontally extending diametric plane of said ball, and constituting a sharp ball-circumscribing rib formed at an intersection of a pair of angled, intersecting annular faces of said fitment projecting from and converging inwardly of a bounding internal wall portion of said fitment and defining a radially inwardly directed, tapered annular wedge terminating in a circumambient ball-encircling apex, ball-support means for biasing said ball upwardly of and out of contact with said sealing ring means when said cap is removed from said container, said ball-support means comprising ball engaging, resilient spring means supporting said ball at a lower end thereof, said spring means being integrally formed with said fitment and extending interiorly therearound and projecting inwardly from said fitment, resiliently to urge said ball upwardly to clear said sealing ring means thereby to establish an annular fluid passage between said ball and said sealing ring means when said cap is removed from said container, sealing lip means integrally formed with said fitment at an upper terminal portion thereof and embracing said applicator ball circumferentially therearound in fluid flow restricting engagement therewith to prevent uncontrolled discharge of fluid from said container when said cap is removed therefrom, said cap being formed on an underside of a top wall thereof with a plurality of fingers disposed as an array oriented symmetrically with respect to a vertical axis of said container, said fingers extending downwardly from said cap interiorly thereof to engage an upper surface of said ball, whereby when said cap is tightened in place on said container, said fingers press down upon and center said ball, urging said ball to displace said resilient ball support means and to shift said ball into fluid-tight sealing engagement with said sealing ring means to prevent escape of fluid from said container during periods of non-use.

2. The structure as set forth in claim 1 wherein said apex of said sealing ring means subtends an angle of from about 60° to about 150°.

3. The structure as set forth in claim 1 wherein said ball support means comprise an annular array of spaced platelets coaxially disposed with respect to and positioned below said sealing ring means, said platelets being directed inwardly and inclined downwardly at a sloping angle to serve as leaf spring means normally to bias said ball upwardly of said sealing ring means to permit fluid flow between said fitment and said ball when said cap is removed from said assembly, and wherein said pressure-applying fingers urge said ball downwardly sealingly to engage said sealing ring means and simultaneously to stress said leaf spring means when said cap is attached to and tightened on said assembly.

4. The structure as set forth in claim 1 wherein said fingers extending downwardly from said cap interiorly thereof are inclined outwardly from a vertical axis of said cap to establish stressed ball-centering contact with said ball at an upper surface thereof.

5. In a roll-on applicator assembly including a container having an outlet end, a ball-type fitment at the outlet end of said container and secured thereto at a mouth thereof, an applicator ball coaxial with and rotatably retained in said fitment, an upper portion of said ball projecting above said fitment and normally exposed when said applicator assembly is in use, a cap positionable as a cover for said fitment and attachable to said container as a closure therefor, sealing ring means integrally formed with said fitment and defining an annular fluid-tight seat for said ball when said cap is applied to close said container, said cap and said ball constituting, in cooperation with said sealing ring means, means to prevent escape of fluid from said container upon closure thereof, said sealing ring means being displaced below a horizontally extending diametric plane of said ball, ball-support means comprising ball-engaging resilient spring means for supporting said ball at a lower end thereof, and for biasing said ball upwardly of and out of contact with said sealing ring means when said cap is removed from said container.

said spring means being integrally formed with said fitment and extending therearound and projecting inwardly from said fitment, resiliently to urge said ball upwardly to clear said sealing ring means thereby to establish an annular fluid passage between said ball and said sealing ring means when said cap is removed from said container, said cap being formed on an underside of a top wall thereof with a plurality of fingers disposed as an array oriented symmetrically with respect to a vertical axis of said container, said fingers extending downwardly from said cap interiorly thereof and being inclined outwardly from a vertical axis of said cap to engage an upper surface of said ball, whereby a tightening of said cap in place on said container causes said downwardly projecting fingers to press down upon and to center and to urge said ball resiliently to displace said ball support means and to shift said ball into fluid-tight sealing engagement with said sealing ring means to prevent escape of fluid from said container during periods of non-use;

the improvement wherein said sealing ring means comprises a sharp, ball-contacting rim formed at and defined by an intersection of a pair of angled, planar annular faces of said fitment projecting from and pitched to converge inwardly of a bounding internal wall portion of said fitment, said rim defining a radially inwardly directed tapered annular wedge terminating in a circumambient ball-encircling apex for establishing a sharp-line fluid-tight contact with said ball when said cap is applied to close said container and to press said ball against said sealing ring.

6. The structure as set forth in claim 5 wherein said apex of said sealing ring subtends an angle of from about 60° to about 150°.

7. In a roll-on applicator assembly including a container having an outlet end, a ball-type fitment at the outlet end of said container and secured thereto at a mouth thereof, an applicator ball coaxial with and rotatably retained in said fitment, an upper portion of said ball projecting above said fitment and normally exposed when said applicator assembly is in use, a cap positionable as a cover for said fitment and attachable to said container as a closure therefor, sealing ring means integrally formed with said fitment and defining an annular fluid-tight seat for said ball when said cap is applied to close said container, said cap and said ball constituting, in cooperation with said sealing ring means, means to prevent escape of fluid from said container upon closure thereof, said sealing ring means being displaced below a horizontally extending diametric plane of said ball, ball-support means comprising ball-engaging resilient spring means for supporting said ball at a lower end thereof, and for biasing said ball upwardly of and out of contact with said sealing ring means when said cap is removed from said container, said spring means being integrally formed with said fitment and extending therearound as annularly spaced platelets projecting inwardly from said fitment, resiliently to urge said ball upwardly to clear said sealing ring means thereby to establish an annular fluid passage between said ball and said sealing ring means when said cap is removed from said container, ball-engaging and positioning means integrally formed with said cap on an underside of a top wall thereof for stressingly engaging and shifting said ball;

the improvement wherein said ball engaging and positioning means comprises three fingers disposed as an array oriented symmetrically with respect to a vertical axis of said container, said fingers extending downwardly from said cap interiorly thereof and being inclined outwardly from a vertical axis of said cap to engage and bear upon an upper surface of said ball, tightening of said cap in place on said container being effective to cause said fingers to press down upon and to center and to urge said ball resiliently to displace said ball support means and to shift said ball into fluid-tight sealing engagement with said sealing ring means to prevent escape of fluid from said container during periods of non-use.

* * * * *